US008261541B2

(12) United States Patent
Takewaki

(10) Patent No.: US 8,261,541 B2
(45) Date of Patent: Sep. 11, 2012

(54) EXHAUST SYSTEM OF OUTBOARD MOTOR

(75) Inventor: Hiromichi Takewaki, Hamamatsu (JP)

(73) Assignee: Suzuki Kabushiki Kaisha, Hamamatsu-shi (JP)

( * ) Notice: Subject to any disclaimer, the term of this patent is extended or adjusted under 35 U.S.C. 154(b) by 629 days.

(21) Appl. No.: 12/248,495

(22) Filed: Oct. 9, 2008

(65) Prior Publication Data

US 2009/0094965 A1 Apr. 16, 2009

(30) Foreign Application Priority Data

Oct. 15, 2007 (JP) ..... 2007-267675

(51) Int. Cl.
*F01N 3/00* (2006.01)

(52) U.S. Cl. ..... 60/302; 60/299

(58) Field of Classification Search ..... 60/299, 60/302

See application file for complete search history.

(56) References Cited

U.S. PATENT DOCUMENTS 5,378,180 A * 1/1995 Nakayama et al. ..... 440/89 R
5,732,555 A * 3/1998 Gracyalny et al. ..... 60/299
6,065,957 A * 5/2000 Kondo et al. ..... 431/116
6,116,022 A * 9/2000 Woodward ..... 60/300
6,662,555 B1 * 12/2003 Ishii ..... 60/302
2001/0029734 A1 * 10/2001 Kato ..... 60/285
2002/0151231 A1 * 10/2002 Nakase et al. ..... 440/89

FOREIGN PATENT DOCUMENTS

JP 2000-356123 12/2000
JP 2005155404 A * 6/2005

* cited by examiner

*Primary Examiner* — Thomas Denion
*Assistant Examiner* — Patrick Maines
(74) *Attorney, Agent, or Firm* — Barnes & Thornburg LLP

(57) ABSTRACT

An exhaust system of an outboard motor includes: an exhaust passage forward portion including exhaust passages for leading exhaust in the exhaust passage of an exhaust manifold; an exhaust passage reversed portion formed in parallel with the exhaust passage of the exhaust passage forward portion and including exhaust passages communicating with an exhaust passage in an engine holder; and an exhaust passage U-turn portion including an exhaust passage communicating with the exhaust passage of the exhaust passage forward portion and the exhaust passage of the exhaust passage reversed portion. A catalyst for purifying the exhaust is disposed at a junction between the exhaust passages.

5 Claims, 11 Drawing Sheets

EXHAUST SYSTEM OF OUTBOARD MOTOR

CROSS-REFERENCE TO RELATED APPLICATIONS

This application is a non-provisional U.S. Utility application based upon and claiming the benefit of priority to Japanese Utility Application No. 2007-267675, filed on Oct. 15, 2007, the contents of which are incorporated herein by reference.

BACKGROUND OF THE INVENTION

1. Field of the Invention

The present invention relates to an exhaust system of an outboard motor and particularly to an exhaust system of an outboard motor in which a catalyst is properly disposed in an exhaust passage.

2. Related Art

An outboard motor discharges exhaust gas from an engine into water. To purify the exhaust gas, an outboard motor is provided with a catalyst in an exhaust passage of the engine. In such arrangement, if the catalyst comes in contact with seawater, for example, and flows back into the exhaust passage, performance of the catalyst is degraded. Therefore, it is preferable to dispose the catalyst in the exhaust passage in an engine cover located away from a water surface (sea surface).

Such arrangement of an outboard motor is, for example, disclosed in Japanese Patent Application Laid-open No. 2000-356123 (Patent Publication 1). In the outboard motor described in the Patent Publication 1, two catalysts are arranged side by side in the exhaust passage, and exhaust gas discharged from the engine is led to the exhaust passage above the engine and then flows through the two catalysts in the same direction to be purified.

In the outboard motor described above, however, the two catalysts are arranged side by side and the exhaust gas flows through the catalysts in the same direction, and therefore, according to increasing in capacity of the catalysts, a flow passage area of the exhaust passage increases and the exhaust gas flow is likely to stagnate. Moreover, the exhaust gas is led to the exhaust passage above the engine before it is led to the two catalysts, the exhaust passage in the engine cover increases in size.

As described above, the outboard motor of the Patent Publication 1 provides problems of increase in size of the exhaust passage and degradation of exhaust purifying performance.

Moreover, in the outboard motor described above, because the catalysts are arranged in side by side and the exhaust gas flows through the catalysts in the same direction, it is necessary for the exhaust gas to be distributed into two passages and led to the respective catalysts. In this case, if the exhaust gas is distributed unevenly, different amounts of the exhaust gas pass through the respective catalysts. Therefore, the catalyst through which excessive exhaust flows cannot sufficiently purify the exhaust gas and, hence, the purifying efficiency of the catalysts may be decreased.

Furthermore, in the outboard motor described of the Patent Publication 1, it is necessary to adjust gaps between the exhaust passage and the catalysts to make sure that the exhaust gas passes through the catalysts. In addition, in the outboard motor, the catalysts are supported by bolts, and when the bolts corrode, it may become difficult to attach or detach the catalysts.

SUMMARY OF THE INVENTION

The present invention was conceived in consideration of the circumstances mentioned above, and an object of the invention is to provide an exhaust system of an outboard motor in which an exhaust passage in an engine cover is miniaturized, exhaust purifying performance of a catalyst is enhanced, and maintenance performance is improved due to easy attachment and detachment of a catalyst.

The above and other objects can be achieved according to the present invention by providing an exhaust system of an outboard motor including an engine mounted vertically and covered with an engine cover and an exhaust unit provided on a side portion of the engine, the exhaust unit including an exhaust passage communicating with exhaust ports in a cylinder head of the engine, the exhaust system comprising:

an exhaust passage forward portion including an exhaust passage communicating with the exhaust passage of the exhaust unit;

an exhaust passage reversed portion including an exhaust passage formed below the exhaust passage of the exhaust passage forward portion in parallel therewith and communicating with an exhaust passage disposed below the engine; and an exhaust passage U-turn portion including an exhaust passage communicating with both the exhaust passages of the exhaust passage forward portion and the exhaust passage reversed portion to reverse a flowing direction of exhaust, wherein a catalyst for purifying the exhaust is disposed at a junction between both the exhaust passages of the exhaust passage forward portion and the exhaust passage reversed portion and the exhaust passage of the exhaust passage U-turn portion.

In a preferred embodiment, it may be desired that the engine is a multicylinder engine, the exhaust unit forms an exhaust collecting portion including the exhaust passage for collecting the exhaust from the exhaust ports in the cylinder head of the multicylinder engine, and the exhaust passage of the exhaust passage forward portion is formed to extend from a central portion of the exhaust passage of the exhaust collecting portion to be substantially perpendicular to the exhaust passage.

It may be desired that the exhaust passage of the exhaust passage forward portion is formed to extend from the central portion of the exhaust passage of the exhaust collecting portion toward a crankcase of the engine.

The catalyst may be disposed in the exhaust passages of the exhaust passage forward portion and the exhaust passage reversed portion or in the exhaust passage of the exhaust passage U-turn portion and pinched by the exhaust passage forward portion, the exhaust passage reversed portion, and the exhaust passage U-turn portion.

The catalyst may be press-fitted in and integrated with the exhaust passage of the exhaust passage U-turn portion.

It may be further desired that the catalyst includes a single catalyst member including a sectional area substantially equal to a sum of sectional areas of both the exhaust passages of the exhaust passage forward portion and the exhaust passage reversed portion.

The catalyst may include two catalyst members including sectional areas substantially equal to sectional areas of the exhaust passages of the exhaust passage forward portion and the exhaust passage reversed portion.

According to the present invention of the characters mentioned above, a sufficient catalyst area is obtainable without increasing the size of the exhaust passage. Since the exhaust gas reliably passes through the catalyst, the exhaust purifying performance of the catalyst can be improved while making the exhaust passage compact.

Moreover, the catalyst is disposed at the junction between both the exhaust passages of the exhaust passage forward portion and the exhaust passage reversed portion and the exhaust passage of the exhaust passage U-turn portion, which facilitates attachment and detachment of the catalyst and improves ease of maintenance.

The nature and further characteristic features of the present invention will be made clearer from the following descriptions made with reference to the accompanying drawings.

DESCRIPTION OF THE PREFERRED EMBODIMENTS

Preferred embodiments of the present invention will be described below based on the drawings. Further, it is to be noted that terms "right", "left", "upper", "lower" and the like used herein in illustrated states or in an actually operating state.

First Embodiment

FIGS. 1 to 9

Figure 1:
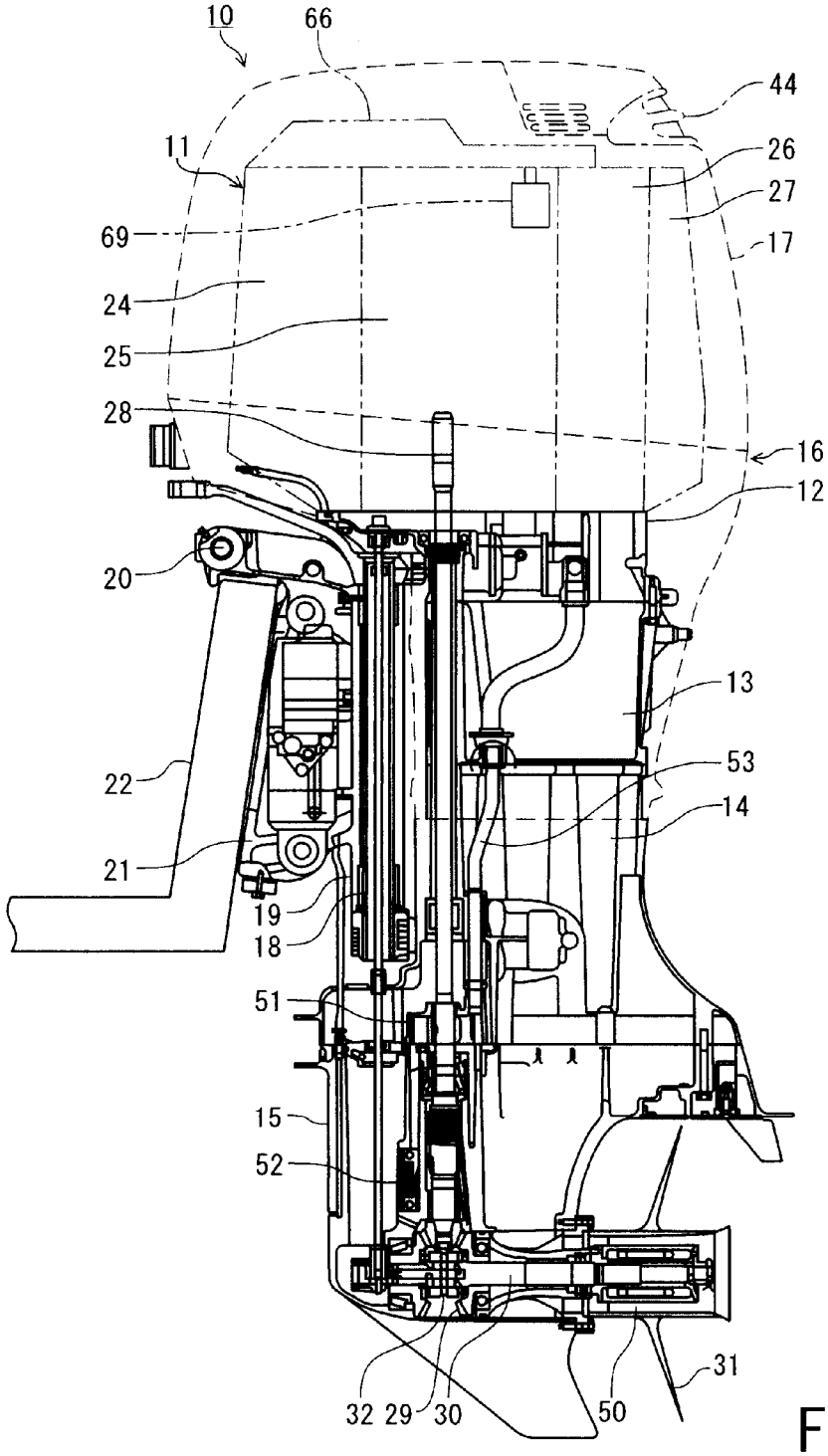
FIG. 1 is a partially-cutaway left side view of an outboard motor to which a first embodiment of an exhaust system of an outboard motor according to the present invention is applied.

With reference to FIGS. 1 to 4, an outboard motor 10 shown in FIG. 1 includes an engine 11 mounted to an engine holder 12. To a lower portion of the engine holder 12, an oil pan block 13, a drive shaft housing 14, and a gear case 15 are mounted in this order. A synthetic resin cover 16 covers a portion from the engine 11 to a portion of the drive shaft housing 14, and the cover 16 includes an engine cover 17 for covering the engine 11.

An upper end portion of a pilot shaft 18 is fixed to the engine holder 12 and, on the other hand, an opposite lower end portion thereof is fixed to the drive shaft housing 14. The pilot shaft 18 is laterally (horizontally) rotatably supported on a swivel bracket 19. The swivel bracket 19 is swingably (vertically) rotatably supported on a cramp bracket 21 by means of a swivel shaft 20, and the cramp bracket 21 is fixed to a stern portion 22 of a hull. In this way, the outboard motor 10 is mounted to the stern portion 22 so as to be turnable in the horizontal and vertical directions.

The engine 11 is a four-cycle multicylinder engine, for example, a four-cycle in-line four-cylinder engine, and disposed vertically, in which a crankshaft, not shown, is oriented in the vertical direction and cylinders 23A, 23B, 23C and 23D (FIG. 5) are oriented in the horizontal direction. The engine 11 is formed by assembling a crankcase 24, a cylinder block 25, a cylinder head 26 and a head cover 27 in this order from a front side toward a rear side of the outboard motor 10.

Rotation of the crankshaft of the engine 11 is transmitted to a drive shaft 28 via a drive gear and a driven gear, not shown. The drive shaft 28 vertically extends through the engine holder 12, the oil pan block 13, the drive shaft housing 14 and the gear case 15, and is engaged with a bevel gear mechanism 29 in the gear case 15. Therefore, rotating force of the crankshaft is transmitted to a propeller shaft 30 which is coupled to the bevel gear mechanism 29 via the drive shaft 28 and the bevel gear mechanism 29, and when the propeller shaft 30 rotates, a propeller 31 is also rotated. Rotation of the drive shaft 28 constantly rotating in one direction is switched between normal and reverse directions by a forward/reverse switching mechanism. Thus, the propeller 31 rotates normally or reversely to move the hull in the forward or rearward direction.

Figure 5:
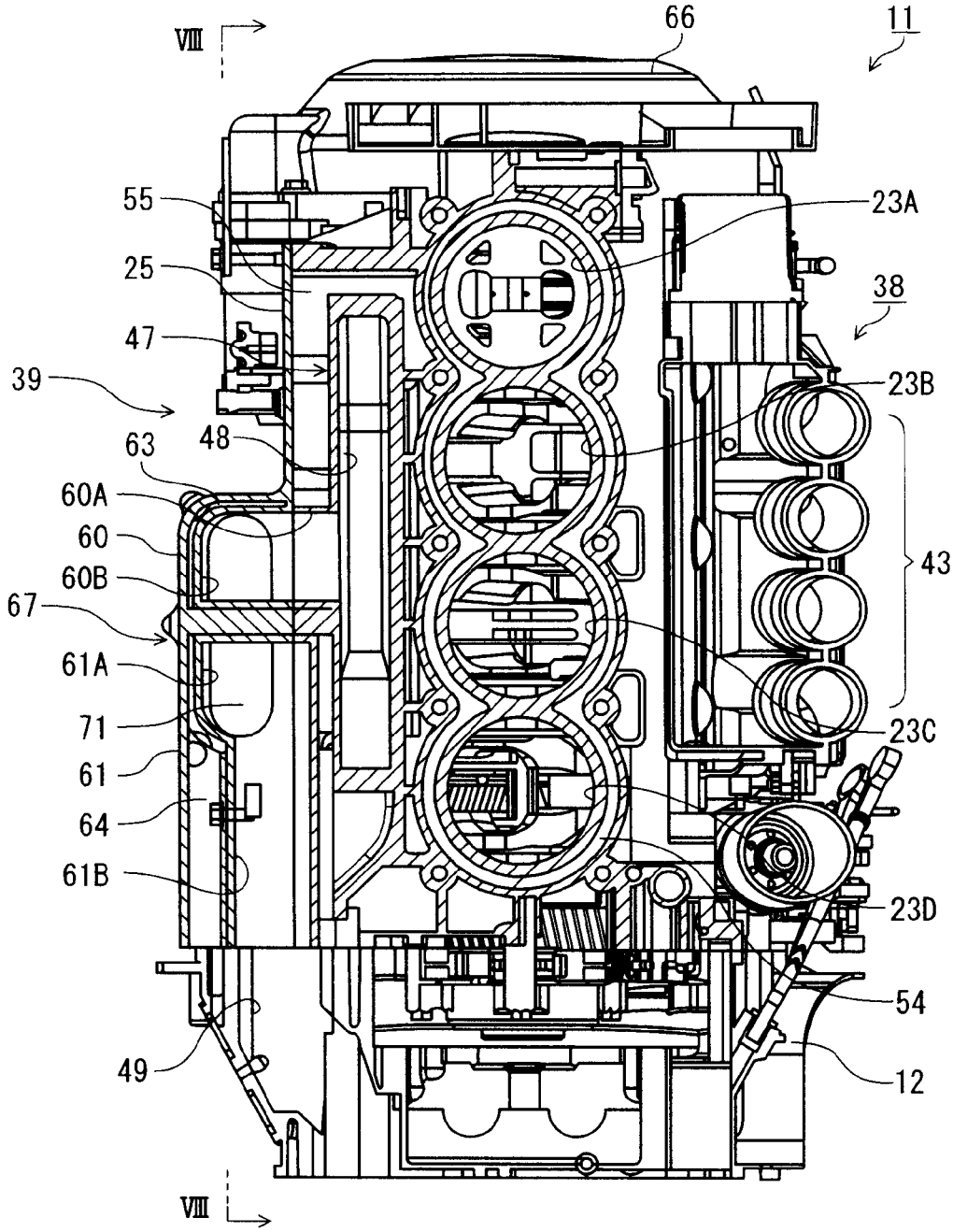
FIG. 5 is a sectional view taken along the line V-V of FIG. 4.
Figure 6:
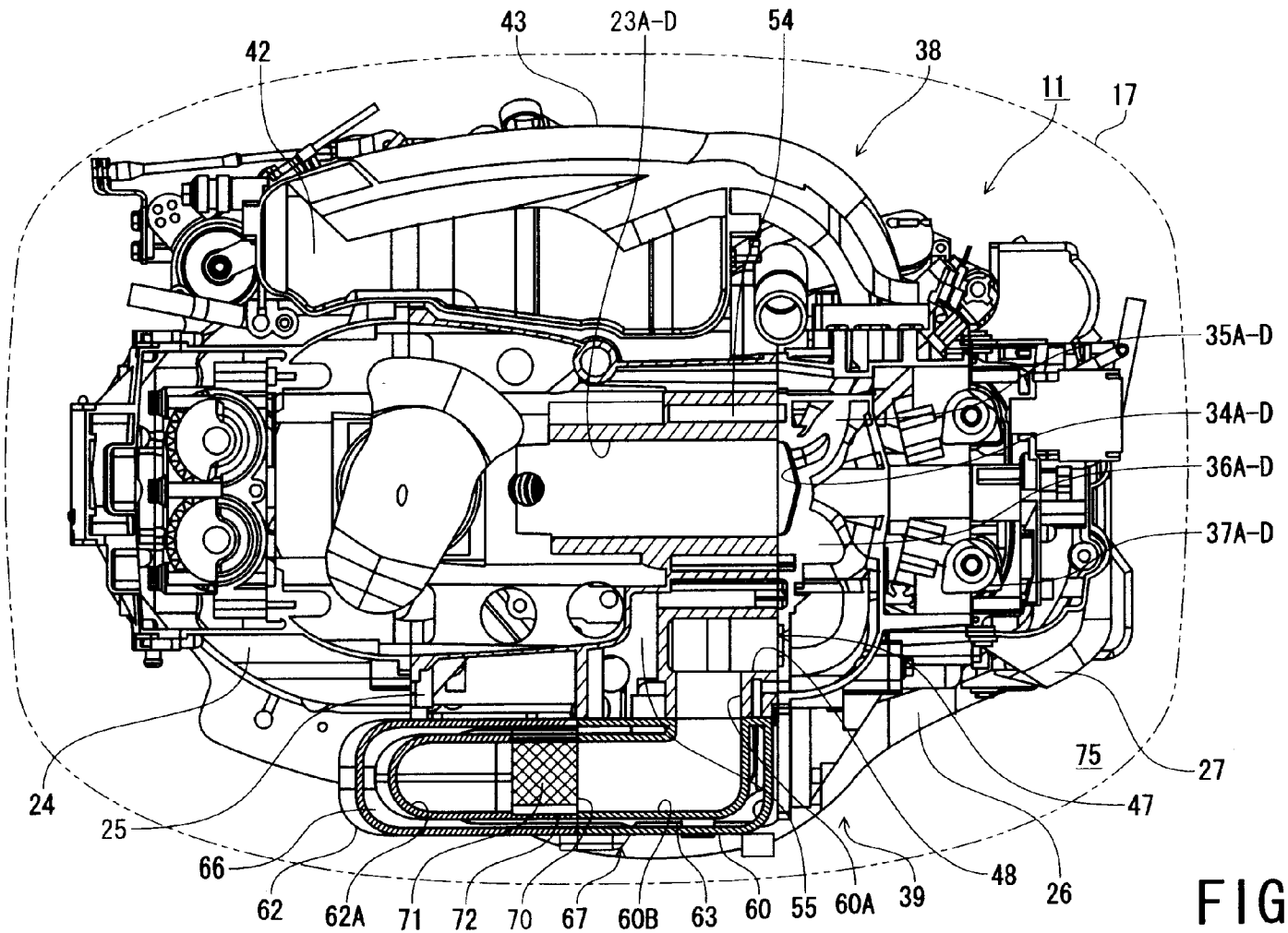
FIG. 6 is a sectional view taken along the line VI-VI of FIG. 4.
Figure 7:
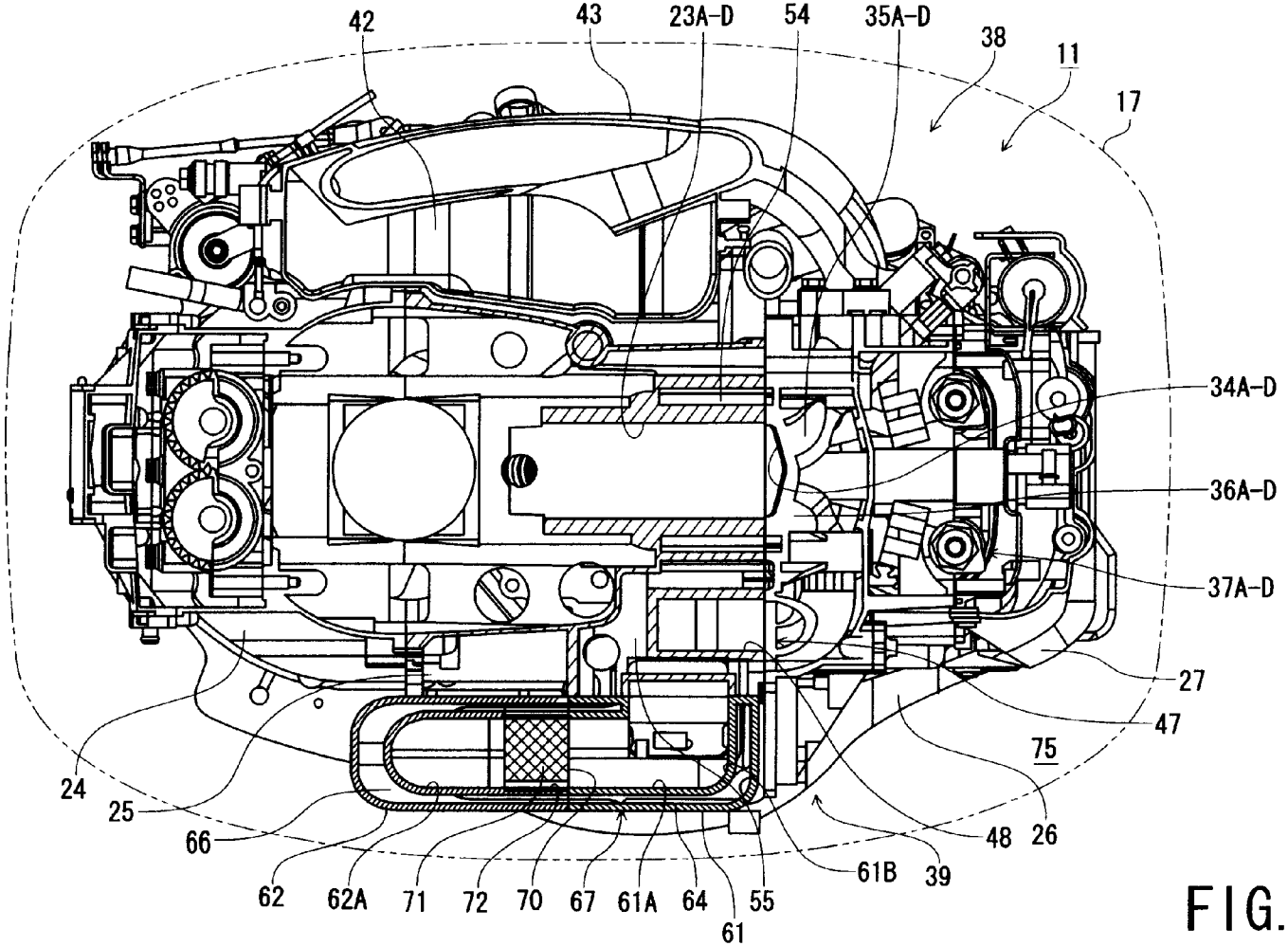
FIG. 7 is a sectional view taken along the line VII-VII of FIG. 4.

As shown in FIGS. 5 to 7, the cylinders 23A, 23B, 23C and 23D are formed in the cylinder block 25 of the engine 11. These cylinders 23A to 23D are arranged in the vertical direction of the outboard motor 10 with their central axes being oriented in the longitudinal (horizontal) direction of the outboard motor 10 and house pistons, not shown. In the cylinder head 26 of the engine 11, combustion chambers 34A, 34B, 34C and 34D are formed in alignment with the cylinders 23A, 23B, 23C and 23D, respectively, and intake ports 35A, 35B, 35C and 35D and exhaust ports 36A, 36B, 36C and 36D are also formed so as to be communicated with the combustion chambers 34A, 34B, 34C and 34D, respectively.

The cylinder head 26 is mounted with fuel injectors for injecting fuel into the intake ports 35A to 35D and provided with intake valves and exhaust valves, not shown, for opening and closing the intake ports 35A to 35D and the exhaust ports 36A to 36D, respectively. In the cylinder head 26, valve trains 37A, 37B, 37C and 37D for operating the intake valves and the exhaust valves are also disposed. The valve trains 37A to 37D are covered with the head cover 27.

The crankshaft is disposed in a crank chamber formed to the crankcase 24 and the cylinder block 25 and is coupled to respective pistons in the cylinders 23A, 23B, 23C and 23D through connection rods, not shown, interposed therebetween. The pistons reciprocate due to combustion of the fuel in the respective combustion chambers 34A to 34D and the reciprocating motion of the piston is converted into rotational motion by the crankshaft and then transmitted to the drive shaft 28 (FIG. 1).

As shown in FIGS. 2 and 5 to 7, around the engine 11, an intake system 38 and associated members are disposed on the right, and on the other hand, an exhaust system 39, a starter 40, and associated members are disposed on the left.

The intake system 38 includes an intake air induction passage 41 (FIG. 2), a surge tank 42, an intake manifold 43 and so on. The intake air induction passage 41 introduces an outside air taken in through an intake air induction port 44 (FIG. 1) of the engine cover 17 through an induction port 45 shown in FIG. 2, and the air is then led to the surge tank 42

(FIGS. 6 and 7) through a throttle body, not shown, connected to the downstream side of an intake hole 46. The intake manifold 43 shown in FIGS. 5 to 7 connects the surge tank 42 and the intake ports 35A to 35D in the cylinder head 26 so as to lead the intake air to the intake ports 35A to 35D, respectively.

In the exhaust system 39, an exhaust manifold 47 as an exhaust collecting portion is extended vertically on a side portion of the cylinder block 25 in the engine 11. In the exhaust manifold 47, an exhaust passage 48 extends in the same direction so as to communicate with the exhaust ports 36A, 36B, 36C and 36D. The exhaust passage 48 in the exhaust manifold 47 communicates with an exhaust passage 49 formed in the engine holder 12 via an exhaust passage forward (outward) portion 60, an exhaust passage U-turn portion 62, and an exhaust passage reversed (homeward) portion 61 so as to collect an exhaust gas from the exhaust ports 36A to 36D of the engine 11. The exhaust gas is led to the exhaust passage 49.

The exhaust gas is led from the exhaust passage 49 in the engine holder 12, via an exhaust passage in the oil pan block 13 shown in FIG. 1, into an exhaust expansion chamber, not shown, in the drive shaft housing 14 where the exhaust is expanded and muffled. Then, the exhaust gas mainly flows through an exhaust passage 50 formed around the propeller shaft 30 in the gear case 15 and is discharged into water.

The engine 11 is a water-cooled engine and uses seawater, for example, as cooling water. In other words, as shown in FIG. 1, the cooling water is taken in from a water intake port 52 provided for the gear case 15 by a water pump 51 driven by the drive shaft 28. The cooling water is then led to a cooling water passage, not shown, formed in the engine holder 12 via a water tube 53 and led to a water jacket 54 around the cylinders 23A to 23D in the cylinder block 25 and a water jacket around the combustion chambers 34A to 34D in the cylinder head 26 to cool the cylinders 23A to 23D and the combustion chambers 34A to 34D.

The cooling water led to the cooling water passage in the engine holder 12 is guided to a water jacket 55 formed around the exhaust passage 48 in the exhaust manifold 47 in the cylinder block 25 and a water jacket formed around the exhaust ports 36A to 36D in the cylinder head 26 to cool the exhaust passage 48 and the exhaust ports 36A to 36D.

Figure 8:
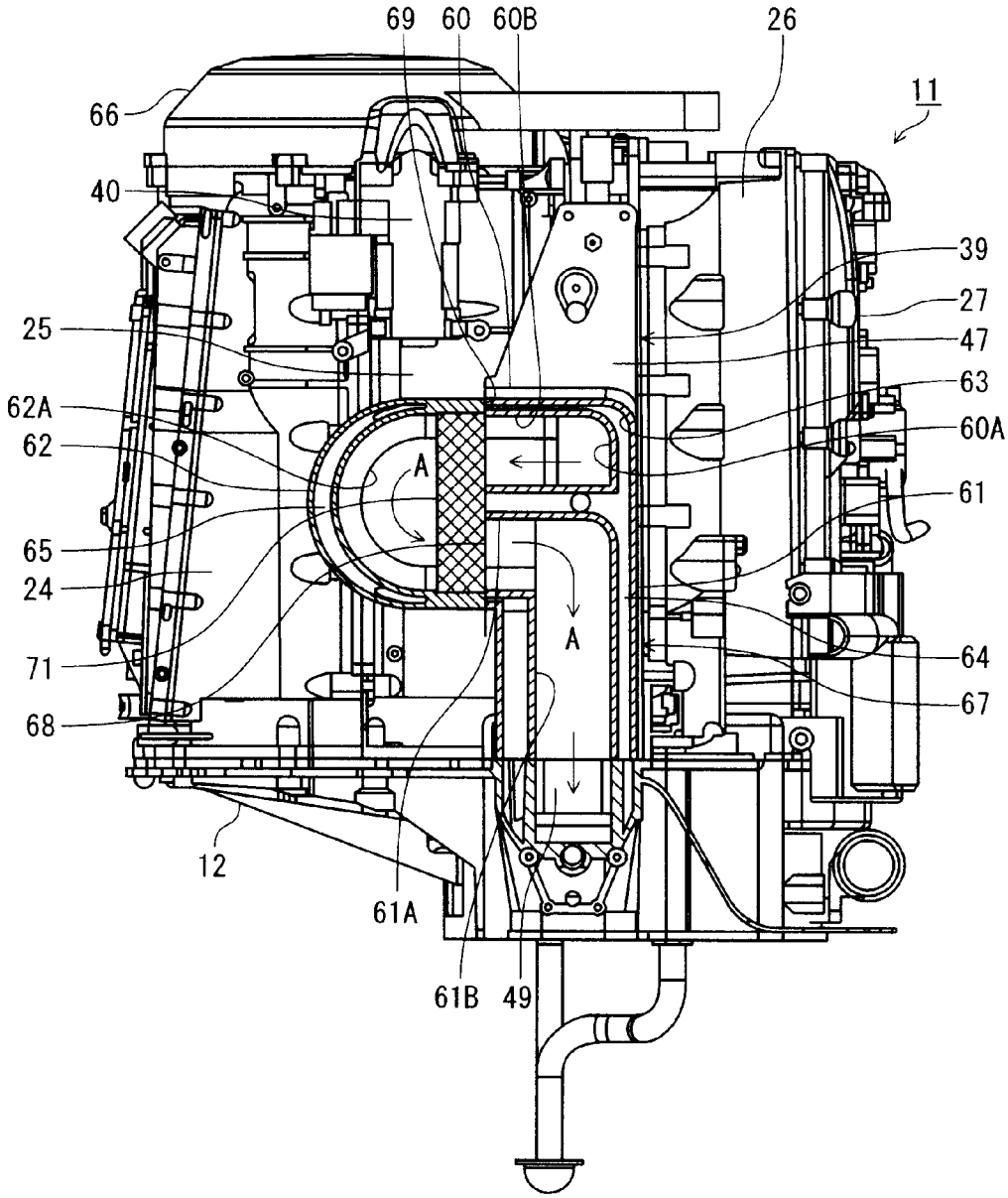
FIG. 8 is a sectional view taken along the line VIII-VIII of FIG. 5.

Furthermore, the cooling water led to the cooling water passage in the engine holder 12 is guided to water jackets 63, 64, and 65 formed around the exhaust passage forward portion 60, the exhaust passage reversed portion 61, and the exhaust passage U-turn portion 62 so as to cool the exhaust passage forward portion 60, the exhaust passage reversed portion 61, and the exhaust passage U-turn portion 62 as shown also in FIG. 8.

The cooling water, that has cooled the cylinders 23A to 23D, the combustion chambers 34A to 34D, the exhaust passage 48 in the exhaust manifold 47, the exhaust ports 36A to 36D, the exhaust passage forward portion 60, the exhaust passage reversed portion 61, and the exhaust passage U-turn portion 62, passes through the other cooling water passage in the engine holder 12, flows down into the exhaust expansion chamber in the drive shaft housing 14 shown in FIG. 1, and is discharged into water from the exhaust passage 50 around the propeller shaft 30 in the gear case 15.

A thermostat or the like, not shown, may be disposed in the above-described cooling water passage to control a flow of the cooling water based on a detected water temperature.

A magnet cover 66 covers a flywheel magnet coupled to the crankshaft, as shown in FIGS. 1 to 5.

Figure 2:
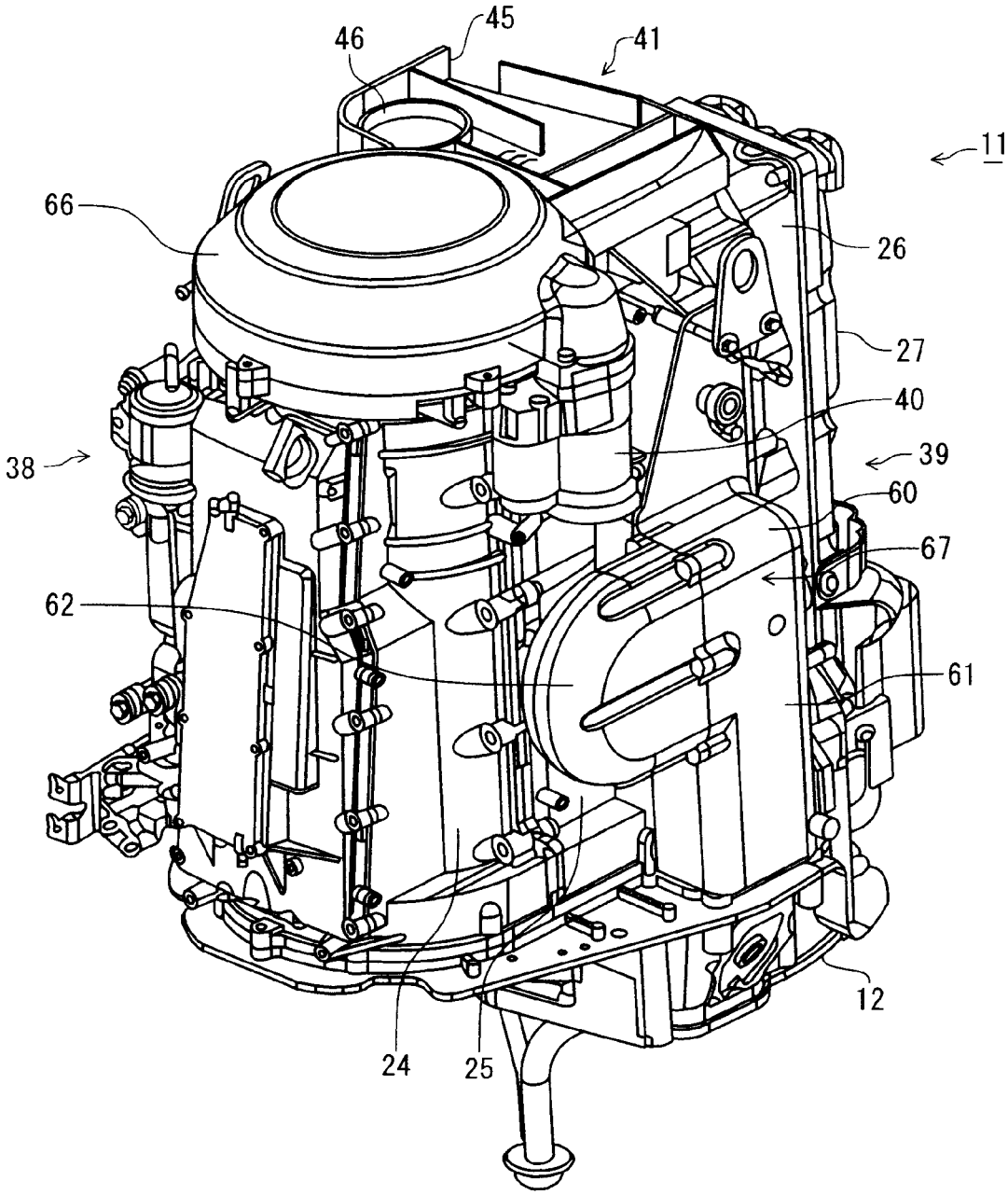
FIG. 2 is a perspective view of an engine and an engine holder in FIG. 1.

As shown in FIGS. 5 and 6, in the exhaust manifold 47, the exhaust gas in the exhaust passage 48 extending in the vertical direction of the engine 11 is guided to the exhaust passage 49 in the engine holder 12 via the exhaust passage forward portion 60, the exhaust passage U-turn portion 62, and the exhaust passage reversed portion 61 shown in FIG. 2 in this order as described above.

As shown in FIGS. 5, 6 and 8, the exhaust passage forward portion 60 extends from a longitudinal central portion of the exhaust passage 48 of the exhaust manifold 47 and outward in a width direction of the engine 11 to be substantially perpendicular to the exhaust passage 48 and includes a first exhaust passage 60A for leading the exhaust gas in the exhaust passage 48 and a second exhaust passage 60B communicating with the first exhaust passage 60A and extending toward the front side (toward the crankcase 24) of the engine 11. The exhaust passage reversed portion 61 includes: a first exhaust passage 61A formed below and parallel to the second exhaust passage 60B of the exhaust passage forward portion 60; and a second exhaust passage 61B communicating with a downstream end of the first exhaust passage 61A and extending vertically downward to be connected to the exhaust passage 49 in the engine holder 12.

Although the first exhaust passage 60A, the second exhaust passage 60B, the first exhaust passage 61A, and the second exhaust passage 61B may be formed on a side surface portion of the cylinder block 25, the first exhaust passage 60A of the exhaust passage forward portion 60 is formed in the cylinder block 25 and the second exhaust passage 60B of the exhaust passage forward portion 60, and the first exhaust passage 61A and the second exhaust passage 61B of the exhaust passage reversed portion 61 are formed in a side surface member 67 secured to the side portion of the cylinder block 25 in the embodiment. Therefore, the second exhaust passage 60B of the exhaust passage forward portion 60 and the exhaust passage reversed portion 61 are integrally formed in the side surface member 67.

As shown in FIG. 8, the exhaust passage U-turn portion 62 includes a U-shaped exhaust passage 62A communicating with the second exhaust passage 60B of the exhaust passage forward portion 60 and the first exhaust passage 61A of the exhaust passage reversed portion 61, causes the exhaust from the second exhaust passage 60B of the exhaust passage forward portion 60 to turn around (U-turn), and leads the exhaust to the first exhaust passage 61A of the exhaust passage reversed portion 61.

Figure 3:
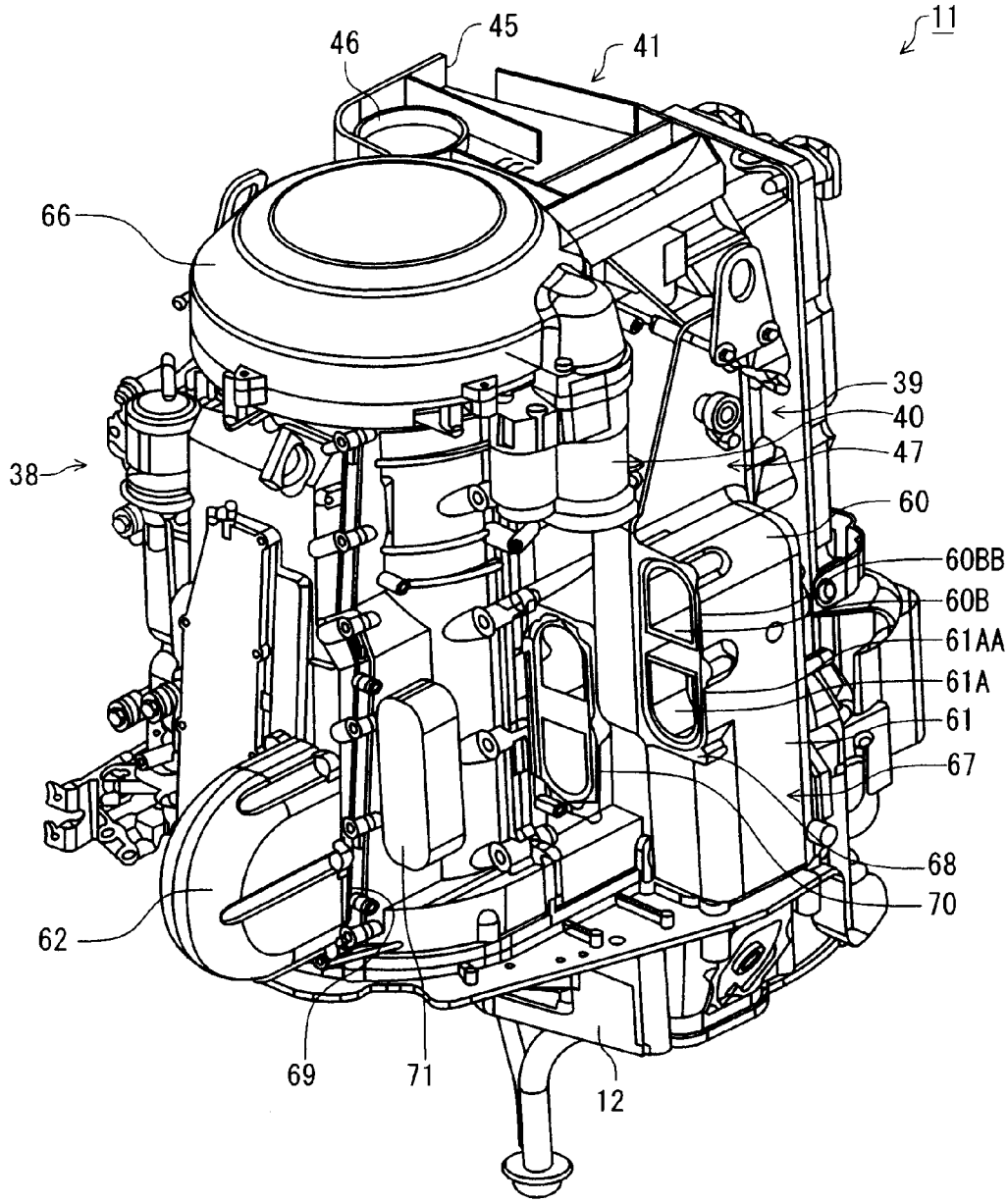
FIG. 3 is a perspective view of a U-turn portion of an exhaust passage, a catalyst, and the like in FIG. 2, which are detached from an exhaust passage forward (outward) portion and an exhaust passage reversed (homeward) portion.
Figure 4:
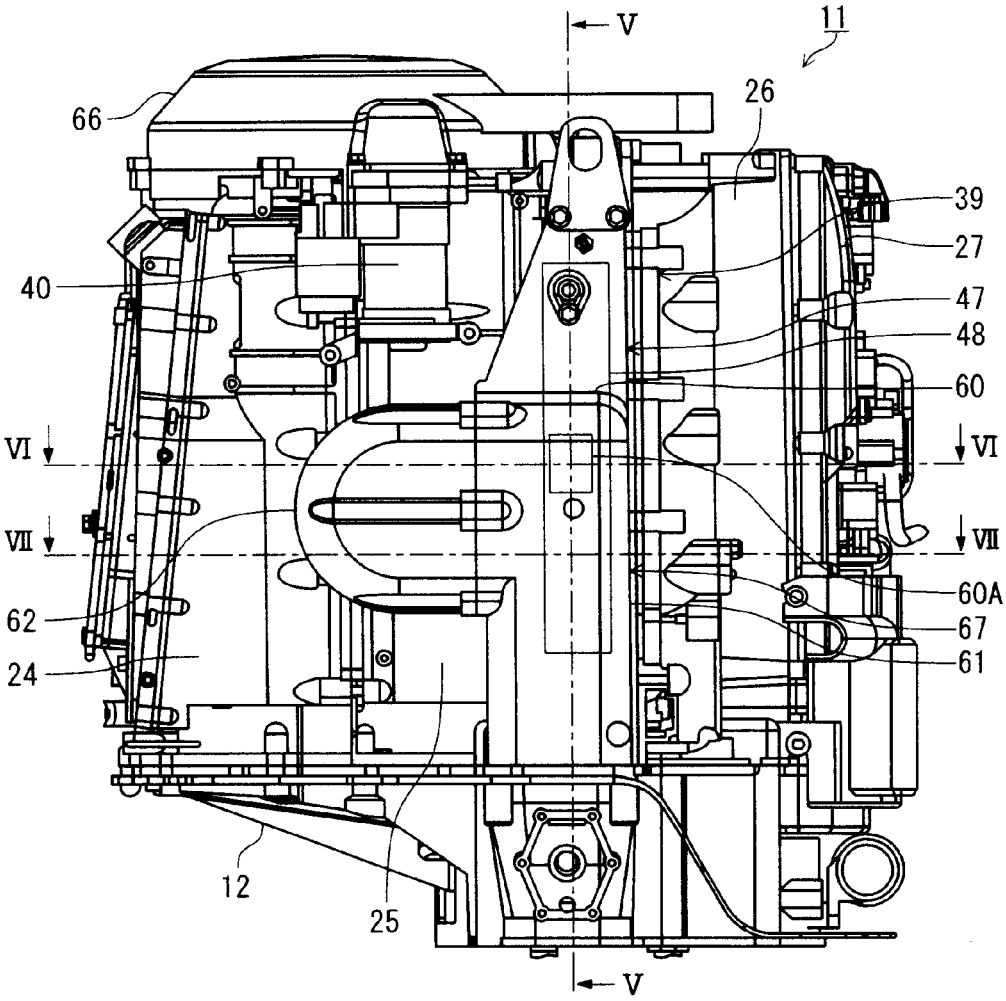
FIG. 4 is a left side view of the engine and the engine holder in FIG. 1.
Figure 9:
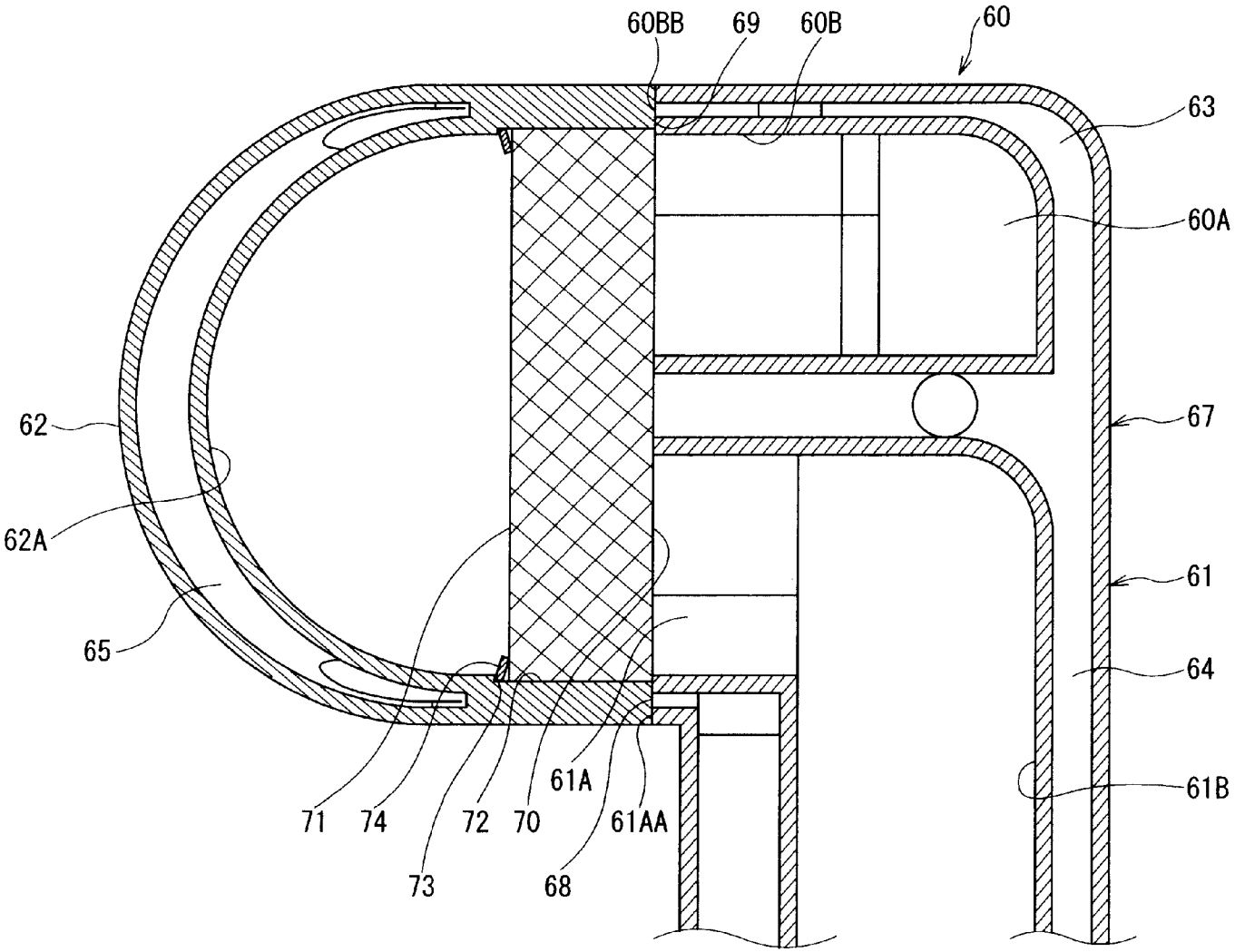
FIG. 9 is an enlarged sectional view of an essential portion of FIG. 8.

As shown in FIGS. 3 and 9, a junction end 60BB of the second exhaust passage 60B of the exhaust passage forward portion 60 and a junction end 61AA of the first exhaust passage 61A of the exhaust passage reversed portion 61 are formed on the same junction end surface portion 68 of the side surface member 67. An opening end surface 69 of the exhaust passage U-turn portion 62 is abutted against the junction end surface portion 68 of the side surface member 67 with a gasket 70 interposed therebetween. In this state, the exhaust passage U-turn portion 62 is detachably mounted to the side surface member 67 by using fixing means such as bolts as shown in FIGS. 2 to 4. In this way, as shown in FIG. 8, the second exhaust passage 60B of the exhaust passage forward portion 60 and the first exhaust passage 61A of the exhaust passage reversed portion 61 are joined to and communicated with the exhaust passage 62A in the exhaust passage U-turn portion 62.

Then, at a junction between the second exhaust passage 60B of the exhaust passage forward portion 60 and the first exhaust passage 61A of the exhaust passage reversed portion 61, and the exhaust passage 62A of the exhaust passage U-turn portion 62, a catalyst 71 for purifying the exhaust gas is disposed. In the embodiment, the catalyst 71 is fitted in a junction position in the exhaust passage 62A of the exhaust passage U-turn portion 62 to be joined to the second exhaust passage 60B of the exhaust passage forward portion 60 and the first exhaust passage 61A of the exhaust passage reversed portion 61 as shown in FIGS. 8 and 9 when the exhaust passage U-turn portion 62 is mounted to the side surface member 67 as shown in FIG. 3. This junction position is in the vicinity of the opening end surface 69 of the exhaust passage U-turn portion 62 joined to the junction end 60BB of the second exhaust passage 60B of the exhaust passage forward portion 60 and the junction end 61AA of the first exhaust passage 61A of the exhaust passage reversed portion 61.

At this time, as shown in FIG. 9, an inner surface portion forming the exhaust passage 62A at the exhaust passage U-turn portion 62 has a fitting surface 72 to be fitted with the catalyst 71 and having a diameter larger than the other inner surface portion and has a step portion 73 between the fitting surface 72 and the other inner surface portion.

A front surface of the catalyst 71 is supported by a spring 74 such as a tapered washer disposed at the step portion 73. A rear surface of the catalyst 71 is supported by the junction end 60BB of the second exhaust passage 60B of the exhaust passage forward portion 60 and the junction end 61AA of the first exhaust passage 61A of the exhaust passage reversed portion 61 (i.e., the junction end surface 68 of the side surface member 67). In this way, the catalyst 71 is pinched between the exhaust passage U-turn portion 62, and the exhaust passage forward portion 60 and the exhaust passage reversed portion 61 by the elastic force of the spring 74.

This catalyst 71 contains platinum, rhodium, palladium or the like, serves to promote oxidation-reduction function of harmful substances such as carbon monoxide (CO), hydrocarbons (CH), nitrogen oxides (NOx) in the exhaust gas flowing through the exhaust passage 48, and changes them into harmless carbon dioxide ($CO_2$), water ($H_2O$), nitrogen ($N_2$), and the like.

As shown in FIG. 3, the catalyst 71 has an oval section with an area substantially equal to the sum of a flow path area of the second exhaust passage 60B of the exhaust passage forward portion 60 and a flow path area of the first exhaust passage 61A of the exhaust passage reversed portion 61. In practice, the catalyst 71 has a sectional area larger than the sum of the flow path areas. Therefore, as shown in FIGS. 8 and 9, the exhaust gas flowing from the second exhaust passage 60B of the exhaust passage forward portion 60 toward the exhaust passage 62A of the exhaust passage U-turn portion 62 flows through an upper half portion of the catalyst 71 and the exhaust gas, which is reversed in the flowing direction in the exhaust passage U-turn portion 62, flows toward the first exhaust passage 61A of the exhaust passage reversed portion 61 through a lower half portion of the catalyst 71. In this way, the exhaust gas is purified by the catalyst 71 during the flowing through the upper half portion and the lower half portion of the catalyst 71.

According to the present embodiment of the structure mentioned above, the following functions and effects (1) to (5) will be attained.

(1) As shown in FIGS. 5 to 8, the exhaust system 39 includes: the exhaust passage forward portion 60 including the first exhaust passage 60A and the second exhaust passage 60B for leading the exhaust gas from the exhaust passage 48 in the exhaust manifold 47; the exhaust passage reversed portion 61 including the first exhaust passage 61A formed parallel to the second exhaust passage 60B of the exhaust passage forward portion 60; and the exhaust passage U-turn portion 62 including the exhaust passage 62A for connecting the second exhaust passage 60B of the exhaust passage forward portion 60 and the first exhaust passage 61A of the exhaust passage reversed portion 61 to reverse the flowing direction of the exhaust gas.

The catalyst 71 is disposed in the junction position in the exhaust passage 62A of the exhaust passage U-turn portion 62 to be joined to the second exhaust passage 60B of the exhaust passage forward portion 60 and the first exhaust passage 61A of the exhaust passage reversed portion 61. Therefore, the exhaust gas from the exhaust passage 48 in the exhaust manifold 47 passes through the catalyst 71 twice and is purified while passing through the second exhaust passage 60B of the exhaust passage forward portion 60, turns in U-shape in the exhaust passage 62A of the exhaust passage U-turn portion 62, and reaches the first exhaust passage 61A of the exhaust passage reversed portion 61.

As a result, in a narrow engine room 75 (FIG. 6) of the outboard motor 10 formed by covering the engine 11 with the engine cover 17, the capacity of the catalyst 71 can be increased to thereby ensure a sufficient catalyst area, and the exhaust gas can be reliably led to the catalyst 71 without increasing the size of the exhaust passage in the exhaust system 39. As a result, the exhaust purifying performance of the catalyst 71 can be improved while making the exhaust passage of the exhaust system 39 compact.

(2) The catalyst 71 is disposed in the junction position in the exhaust passage 62A of the exhaust passage U-turn portion 62 to be joined to the second exhaust passage 60B of the exhaust passage forward portion 60 and the first exhaust passage 61A of the exhaust passage reversed portion 61. Therefore, the catalyst 71 can be easily detached from and attached to the exhaust passage U-turn portion 62 by detaching the exhaust passage U-turn portion 62 from the exhaust passage forward portion 60 and the exhaust passage reversed portion 61 (i.e., the side surface member 67). Detachment and attachment of the catalyst 71 becomes easy in this way, thereby improving the maintenance of the catalyst 71.

(3) One catalyst 71 is disposed in the exhaust passage 62A of the exhaust passage U-turn portion 62, the exhaust gas flowing from the second exhaust passage 60B of the exhaust passage forward portion 60 toward the exhaust passage 62A of the exhaust passage U-turn portion 62 passes through the upper half portion of the catalyst 71 so as to be purified, and the exhaust gas flowing from the exhaust passage 62A of the exhaust passage U-turn portion 62 toward the first exhaust passage 61A of the exhaust passage reversed portion 61 passes through the lower half portion of the catalyst 71 so as to be purified. Therefore, the exhaust purifying efficiency can be improved. At the same time, the number of catalysts 71 can be reduced. Thus, the maintenance cost can be reduced and the easiness of assembling the catalyst 71 can be improved.

(4) The catalyst 71 has the sectional area substantially equal to the sum of the respective flow path areas of the second exhaust passage 60B of the exhaust passage forward portion 60 and the first exhaust passage 61A of the exhaust passage reversed portion 61, and this catalyst 71 is disposed in the exhaust passage 62A of the exhaust passage U-turn portion 62. Therefore, an outer peripheral portion of the catalyst 71 is in contact with the exhaust passage U-turn portion 62 and is cooled by the cooling water flowing through the water jacket 65 of the exhaust passage U-turn portion 62. However, an inner portion except the outer peripheral portion of the catalyst 71 is not cooled too much by the cooling water, and thus, the performance of the catalyst 71 can be prevented from degrading.

(5) The catalyst 71 is pinched between the exhaust passage U-turn portion 62, and the exhaust passage forward portion 60 and the exhaust passage reversed portion 61 by the action of the elasticity of the spring 74 (FIG. 9). It is therefore possible to prevent displacement of the catalyst 71 by the pressure of the exhaust gas flowing through the second exhaust passage 60B of the exhaust passage forward portion 60, the exhaust passage 62A of the exhaust passage U-turn portion 62, and the first exhaust passage 61A of the exhaust passage reversed portion 61.

The catalyst 71 may be press-fitted in the exhaust passage 62A of the exhaust passage U-turn portion 62 and formed integrally with the exhaust passage U-turn portion 62 instead of being pinched by the exhaust passage U-turn portion 62, the exhaust passage forward portion 60, and the exhaust passage reversed portion 61. In this case, both the catalyst 71 and the exhaust passage U-turn portion 62 are replaced at the time of replacement of the catalyst 71. Therefore, mis-assembling of the catalyst 71 can be prevented.

Second Embodiment

FIG. 10

Figure 10:
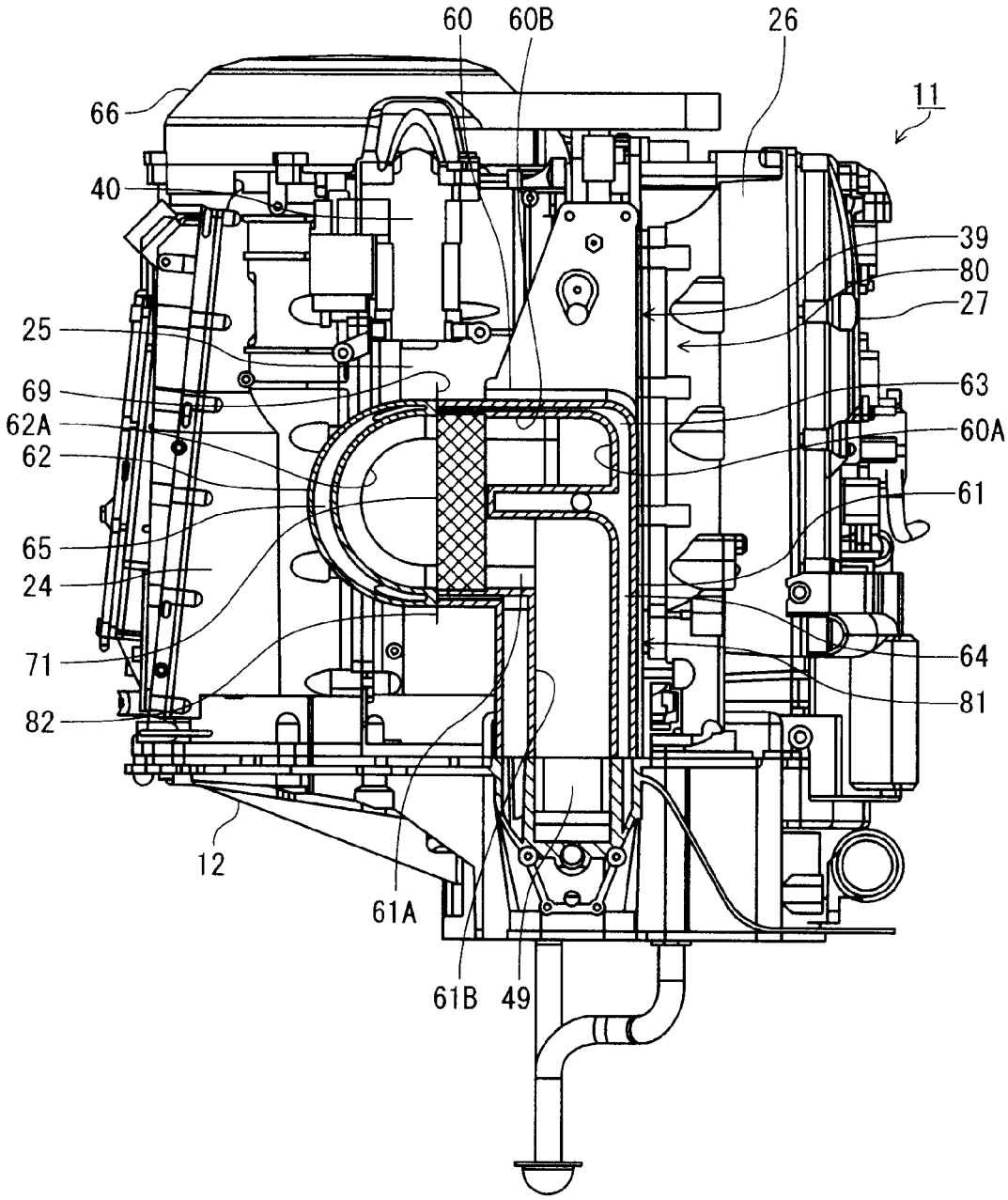
FIG. 10 is a sectional view corresponding to FIG. 8 and showing an engine of an outboard motor to which a second embodiment of an exhaust system of an outboard motor according to the invention is applied.

FIG. 10 is a sectional view corresponding to FIG. 8 and showing an engine and associated portions of an outboard motor to which a second embodiment of the exhaust system of the present invention is applicable.

In the second embodiment, the same reference numerals are added to portions or members similar or corresponding to those in the first embodiment and duplicated description is omitted or simplified herein.

An exhaust system 80 of the outboard motor in this embodiment is different from the exhaust system 39 in the first embodiment in that the catalyst 71 is not disposed in the exhaust passage U-turn portion 62 but in a side surface member 81 formed by integrating the exhaust passage forward portion 60 and the exhaust passage reversed portion 61 with each other.

In other words, the catalyst 71 is fitted in an area of the side surface member 81 that is inside a junction end surface portion 82 to be abutted and joined to the opening end surface 69 of the exhaust passage U-turn portion 62 and forms a portion of the second exhaust passage 60B of the exhaust passage forward portion 60 and the first exhaust passage 61A of the exhaust passage reversed portion 61.

The catalyst 71 is pinched by the exhaust passage U-turn portion 62 and the side surface member 81 (i.e., the exhaust passage forward portion 60 and the exhaust passage reversed portion 61) by the elastic force of the spring 74 (not shown in FIG. 10) disposed between the rear surface and the side surface member 81.

According to the embodiment, the catalyst 71 is disposed at the junction between the exhaust passage forward portion 60 having the second exhaust passage 60B and the exhaust passage reversed portion 61 having the first exhaust passage 61A, and the exhaust passage U-turn portion 62 having the exhaust passage 62A. The exhaust gas flowing from the second exhaust passage 60B of the exhaust passage forward portion 60 toward the exhaust passage 62A of the exhaust passage U-turn portion 62 flows through the upper half portion of the catalyst 71 so as to be purified. The exhaust gas flows in the direction reversed in the exhaust passage 62A of the exhaust passage U-turn portion 62 toward the first exhaust passage 61A of the exhaust passage reversed portion 61 flows through the lower half portion of the catalyst 71 so as to be purified. As a result, this embodiment also exerts effects the same as or similar to those (1) to (5) of the first embodiment.

Third Embodiment

FIG. 11

Figure 11:
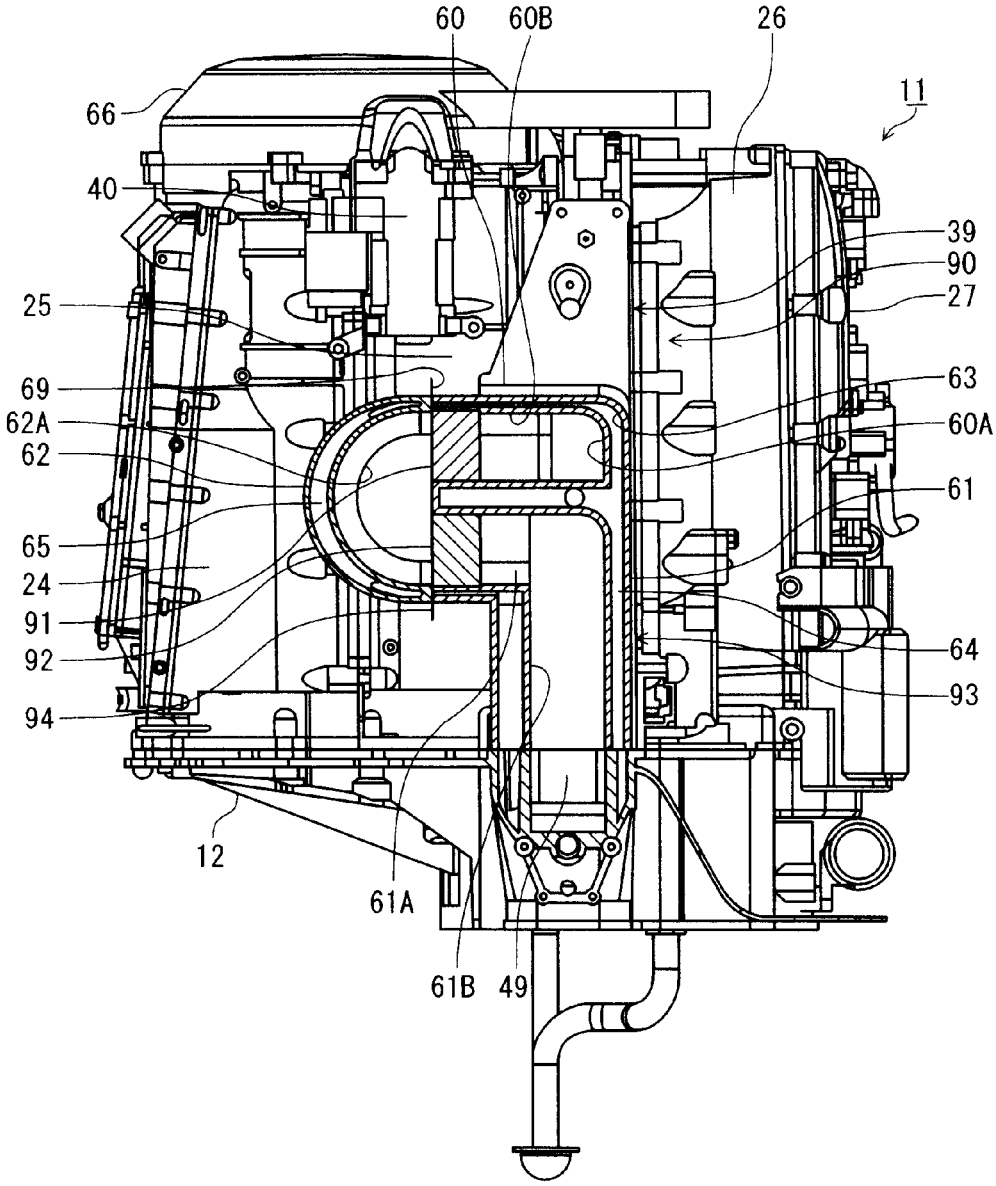
FIG. 11 is a sectional view corresponding to FIG. 8 and showing an engine of an outboard motor to which a third embodiment of an exhaust system of an outboard motor according to the invention is applied.

FIG. 11 is a sectional view corresponding to FIG. 8 and showing an engine and associated portions of an outboard motor to which a third embodiment of the exhaust system of the present invention is applicable.

In the third embodiment, like reference numerals are added to portions or members similar or corresponding to those in the first embodiment, and duplicated description will be omitted herein.

An exhaust system 90 of the outboard motor in this third embodiment is different from the exhaust system 39 in the first embodiment in that two catalysts (catalysts 91, 92) are disposed in a side surface member 93 formed by integrating the exhaust passage forward portion 60 and the exhaust passage reversed portion 61 with each other, or in the exhaust passage U-turn portion 62 (in the side surface member 93 in this embodiment).

A catalyst 91 is fitted in an area of the side surface member 93 that is inside a junction end surface 94 to be abutted and joined to the opening end surface 69 of the exhaust passage U-turn portion 62 and forms a portion of the second exhaust passage 60B of the exhaust passage forward portion 60.

Furthermore, a catalyst 92 is fitted in an area of the side surface member 93 that is inside the junction end surface 94 and forms a portion of the first exhaust passage 61A of the exhaust passage reversed portion 61. The catalyst 91 has a circular section with an area substantially equal to a sectional area of the second exhaust passage 60B of the exhaust passage forward portion 60. The catalyst 92 has a circular section with an area substantially equal to a sectional area of the first exhaust passage 61A of the exhaust passage reversed portion 61.

The respective catalysts 91 and 92 are pinched by the exhaust passage U-turn portion 62 and the side surface member 93 (i.e., the exhaust passage forward portion 60 and the exhaust passage reversed portion 61) by the elastic force of the spring 74 (not shown in FIG. 11) disposed between rear surface portions of the catalysts 91 and 92 and the side surface member 93.

Therefore, in this embodiment, the exhaust gas flowing from the second exhaust passage 60B of the exhaust passage forward portion 60 toward the exhaust passage 62A of the exhaust passage U-turn portion 62 flows through the catalyst 91 so as to be purified. The exhaust gas flows in the direction reversed in the exhaust passage U-turn portion 62 toward the first exhaust passage 61A of the exhaust passage reversed portion 61 through the catalyst 92 so as to be purified.

As a result, this third embodiment exerts effects similar to the effects (1) to (3) and (5) of the first embodiment together with the following effect (6).

(6) The exhaust gas, which flows through the second exhaust passage 60B of the exhaust passage forward portion 60, the exhaust passage 62A of the exhaust passage U-turn portion 62, and the first exhaust passage 61A of the exhaust passage reversed portion 61 in this order, flows through the two catalysts 91 and 92. Therefore, the catalysts 91 and 92 may be of different kinds. In this case, the different kinds of catalysts 91 and 92 will equally remove harmful substances in the exhaust gas to thereby purify the exhaust.

Further, it is to be noted that although the invention has been described above with reference to the embodiments, the invention is not limited to such embodiments, and many other changes and modifications may be made without departing from the scopes of the appended claims.

For example, the second exhaust passage 60B in the exhaust passage forward portion 60 may be formed to extend not toward the crankcase 24 but toward the cylinder head 26, and the exhaust passage U-turn portion 62 may be disposed on the side of the cylinder head 26.

What is claimed is:

1. An exhaust system of an outboard motor including multi-cylinder engine mounted vertically and covered with an engine cover and an exhaust unit provided on a side portion of the engine, the exhaust unit including an exhaust collecting portion including an exhaust passage for collecting an exhaust from exhaust ports in a cylinder head of the engine, the exhaust system comprising:

an exhaust passage forward portion including an exhaust passage communicating with the exhaust passage of the exhaust collecting portion, the exhaust passage forward portion being formed so as to extend from a central portion of the exhaust passage of the exhaust collecting portion toward a crank case of the engine to be perpendicularly angled away from the exhaust passage of the exhaust collecting portion;

an exhaust passage reversed portion including an exhaust passage formed below the exhaust passage of the exhaust passage forward portion in parallel therewith and communicating with an exhaust passage disposed below the engine;

a side surface member secured to a side portion of a cylinder block of the engine, the side surface member being formed so as to extend along a crank shaft and being provided with the exhaust passage of the exhaust passage forward portion and the exhaust passage of the exhaust passage reversed portion, integrally; and an exhaust passage U-turn portion attached to the side surface member for covering openings of the exhaust passages both of the exhaust passage forward portion and the exhaust passage reversed portion, the exhaust passage U-turn portion including an exhaust passage communicating with both the exhaust passages of the exhaust passage forward portion and the exhaust passage reversed portion to reverse a flowing direction of exhaust, wherein a catalyst for purifying the exhaust is disposed either in the exhaust passages of the exhaust passage forward portion and the exhaust passage reversed portion or in the exhaust passage of the exhaust passage U-turn portion and pinched by the exhaust passage forward portion, the exhaust passage reversed portion, and the exhaust passage U-turn portion.

2. The exhaust system of an outboard motor according to claim 1, wherein the catalyst is press-fitted in and integrated with the exhaust passage of the exhaust passage U-turn portion.

3. The exhaust system according to claim 2, wherein the catalyst is supported by a spring so as to press the catalyst toward the side surface member.

4. The exhaust system of an outboard motor according to claim 1, wherein the catalyst includes a single catalyst member including a sectional area equivalent to a sum of sectional areas of both the exhaust passages of the exhaust passage forward portion and the exhaust passage reversed portion.

5. The exhaust system of claim 1, wherein the U-turn portion is attached to the side surface member to be detachable by means of a bolt.

* * * * *